US010426710B2

(12) United States Patent
Jones et al.

(10) Patent No.: US 10,426,710 B2
(45) Date of Patent: Oct. 1, 2019

(54) SYSTEM, METHOD AND APPARATUS FOR TEETHING DEVICE

(71) Applicant: RCJ OPERATIONS TEXAS, LLC, Austin, TX (US)

(72) Inventors: Renee Jones, Austin, TX (US); Teresa Helm, Austin, TX (US)

(73) Assignee: Teetherpop, LLC, Austin, TX (US)

( * ) Notice: Subject to any disclaimer, the term of this patent is extended or adjusted under 35 U.S.C. 154(b) by 805 days.

(21) Appl. No.: 14/398,636

(22) PCT Filed: Sep. 24, 2014

(86) PCT No.: PCT/US2014/057215
§ 371 (c)(1),
(2) Date: Nov. 3, 2014

(87) PCT Pub. No.: WO2015/048132
PCT Pub. Date: Apr. 2, 2015

(65) Prior Publication Data

US 2016/0262986 A1 Sep. 15, 2016

Related U.S. Application Data

(60) Provisional application No. 61/881,845, filed on Sep. 24, 2013.

(51) Int. Cl.
*A61J 17/00* (2006.01)
*A61J 11/00* (2006.01)
*A61J 17/02* (2006.01)

(52) U.S. Cl.
CPC ..... *A61J 17/006* (2015.05); *A61J 11/0085* (2013.01); *A61J 17/001* (2015.05);
(Continued)

(58) Field of Classification Search
CPC .... A61J 17/006; A61J 17/001; A61J 11/0085; A61J 17/02; A61J 2200/42; A61J 2200/44; A61J 17/00–02; A61J 11/00–045
(Continued)

(56) References Cited

U.S. PATENT DOCUMENTS

D194,728 S 2/1963 Ferguson
D213,167 S 1/1969 Ferguson
(Continued)

FOREIGN PATENT DOCUMENTS

WO WO2012146884 * 11/2012 ..... A61J 17/00

OTHER PUBLICATIONS

Math Warehouse;A Circle is a special kind of Ellipse;http://www.mathwarehouse.com/ellipse/is-circle-an-ellipse.php.Jun. 23, 2017.*
(Continued)

*Primary Examiner* — Eric J Rosen
*Assistant Examiner* — Mikail A Mannan
(74) *Attorney, Agent, or Firm* — Dickinson Wright, PLLC; Michael E. Noe, Jr.

(57) ABSTRACT

A teething device can include a base having a handle, and a coupling on an opposite end. The base and coupling can be formed from a first material having a first hardness. A reservoir may be configured to contain a liquid therein. The reservoir may be coupled and sealed to the base coupling and configured to provide a watertight seal. The reservoir can have at least one self-sealing aperture. The self-sealing aperture can have a default position wherein the self-sealing aperture is configured to be substantially closed to essentially prevent the liquid from flowing therethrough, and a flexed position wherein the self-sealing aperture is configured to be opened to allow the liquid to flow therethrough.
(Continued)

In addition, the reservoir can be formed from a second material having a second hardness that is softer than the first hardness.

18 Claims, 7 Drawing Sheets

(52) U.S. Cl.
CPC ..... *A61J 17/02* (2013.01); *A61J 2200/42* (2013.01); *A61J 2200/44* (2013.01)

(58) Field of Classification Search
USPC ..... 606/235
See application file for complete search history.

(56) References Cited

U.S. PATENT DOCUMENTS 3,669,117 A 6/1972 Herbst
3,875,940 A 4/1975 Beuther
4,192,307 A 3/1980 Baer
5,013,321 A 5/1991 MacVane
5,078,734 A * 1/1992 Noble ..... A61J 17/006 215/11.1
5,300,089 A 4/1994 Sassin
5,364,348 A 11/1994 Berry
D368,778 S 4/1996 Kino
5,606,871 A * 3/1997 Hansen ..... F25D 3/08 606/235
5,782,868 A 7/1998 Moore, Jr. et al.
5,908,440 A * 6/1999 McCloskey ..... A61J 17/02 606/234
5,964,784 A * 10/1999 Wang ..... A61J 17/001 606/234
D440,718 S 4/2001 Florance
6,524,272 B1 2/2003 Berry
D493,941 S 8/2004 Shecter
8,408,408 B1 * 4/2013 Dumm ..... A61J 11/04 119/71
D736,572 S 8/2015 Trumbo et al.
D737,095 S 8/2015 Trumbo et al.
D738,171 S 9/2015 Masalin et al.
2003/0014078 A1 1/2003 Robbins
2003/0018359 A1 1/2003 Tuckey
2004/0158200 A1 8/2004 Berry
2005/0245861 A1 * 11/2005 Dunn ..... A61J 9/00 604/77
2006/0058845 A1 * 3/2006 Fuisz ..... A61J 7/0046 606/234
2006/0144810 A1 * 7/2006 Mallet ..... A61J 9/00 215/11.1
2006/0155332 A1 7/2006 Jewett
2007/0102388 A1 * 5/2007 Lewis ..... A61J 11/0015 215/11.1
2007/0225638 A1 * 9/2007 Stewart ..... A61J 17/006 604/77
2009/0287247 A1 11/2009 Chipperson et al.
2010/0230372 A1 * 9/2010 Lo ..... A61J 9/005 215/11.1
2011/0029017 A1 2/2011 Shreve
2013/0085530 A1 4/2013 Caputo
2013/0299502 A1 * 11/2013 Lo ..... A61J 9/005 220/574
2013/0331888 A1 * 12/2013 Antinnes ..... A61J 17/001 606/236
2014/0074165 A1 3/2014 Paxson et al.
2014/0296915 A1 * 10/2014 Finney ..... A61J 17/006 606/236

OTHER PUBLICATIONS

International Search Report & Written Opinion dated Jan. 2, 2015, with regard to International Application No. PCT/US2014/057215 (5 pgs).
Akachan BOON Pulp Feeder, 2003-2012, 4 pgs.
Technical Search, Jul. 18, 2013, 2 pgs.
U.S. Appl. No. 29/496,606, filed Jul. 15, 2014.
"The First Years John Deere Massaging Corn Teether". Found online Aug. 24, 2015 at amazon.com. Page dated Jul. 17, 2008. Retrieved from http://www.amazon.com/The-First-Years-Massaging-Teether/dp/B0013FCBJO/ref=cm_cr_pr_product_top?ie=UTF8.
"Munchkin Fresh Food Feeder". Found online Aug. 24, 2015 at amazon.com. Page dated Nov. 17, 2005. Retrieved from http://www.amazon.com/Munchkin-Fresh-Food-Feeder-Green/dp/B0009ET93Q/ref=cm_cr pr_product_top?ie=UTF8.
"Sassy Teething Feeder". Found online Aug. 24, 2015 at amazon.com. Page dated Nov. 17, 2005. Retrieved from http://www.amazon.com/Sassy-Teething-Feeder-Discontinued-Manufacturer/dp/B0014PLGS/ref=cm_cr_pr_product_top?ie=UTF8.

* cited by examiner

SYSTEM, METHOD AND APPARATUS FOR TEETHING DEVICE

FIELD OF THE DISCLOSURE

The present invention relates in general to teething and, in particular, to a system, method and apparatus for a teething device.

DESCRIPTION OF THE RELATED ART

Some teething devices incorporate a freezable liquid-filled device for the purpose of soothing teething pain. Such devices typically include a sealed reservoir in which a freezable liquid is placed by the manufacturer. Users can chew on the device and the frozen liquid inside of it to apply a cold surface to their gums. Once the liquid melts, the device is typically washed and returned to a freezer to allow the enclosed liquid to be re-frozen for future use. Other teething devices include mini-popsicles for teething babies. These designs include a conventional frozen popsicle mounted to a plastic handle. Although popular, mini-popsicles melt quickly and can be quite messy. Although these existing designs are workable, improvements in teething devices continue to be of interest.

SUMMARY

Embodiments of a system, method and apparatus for a teething device are disclosed. For example, a teething device can include a base having a handle on an end and a coupling on an opposite end. The base and coupling can be formed from a first material having a first hardness. A reservoir may be configured to contain a liquid therein. The reservoir may be coupled and sealed to the base coupling and configured to provide a watertight seal. The reservoir can have at least one self-sealing aperture formed therein. The self-sealing aperture can have a default position wherein the one self-sealing aperture is configured to be substantially closed to essentially prevent the liquid from flowing therethrough, and a flexed position wherein the self-sealing aperture is configured to be opened to allow the liquid to flow therethrough. In addition, the reservoir can be formed from a second material having a second hardness that is softer than the first hardness, such that the reservoir is configured to be used as a teething device.

The foregoing and other objects and advantages of these embodiments will be apparent to those of ordinary skill in the art in view of the following detailed description, taken in conjunction with the appended claims and the accompanying drawings.

BRIEF DESCRIPTION OF DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Embodiments of a system, method and apparatus for a teething device are disclosed. To alleviate pain within the mouth, a user may have a teething device placed within the mouth. The user may bite or suck a distal end of a reservoir of the teething device. The distal end of the reservoir may include one or more self-sealing apertures from which a liquid may exit the reservoir in response to the biting or sucking of the user. This design can provide a superior "no-mess" solution to conventional frozen popsicles. The reservoir may be secured to and/or situated in a top coupling and form a watertight seal, or a substantially watertight seal, with a base coupling. In some versions, the reservoir may be made as part of the coupling. The liquid may be placed in the reservoir from a proximal end of the reservoir, which may sealingly engage with a top surface of a base of the teething device. The liquid may be frozen within the reservoir and may thaw when placed in the user's mouth. The base may have a handle coupled opposite the top surface.

Figure 1:
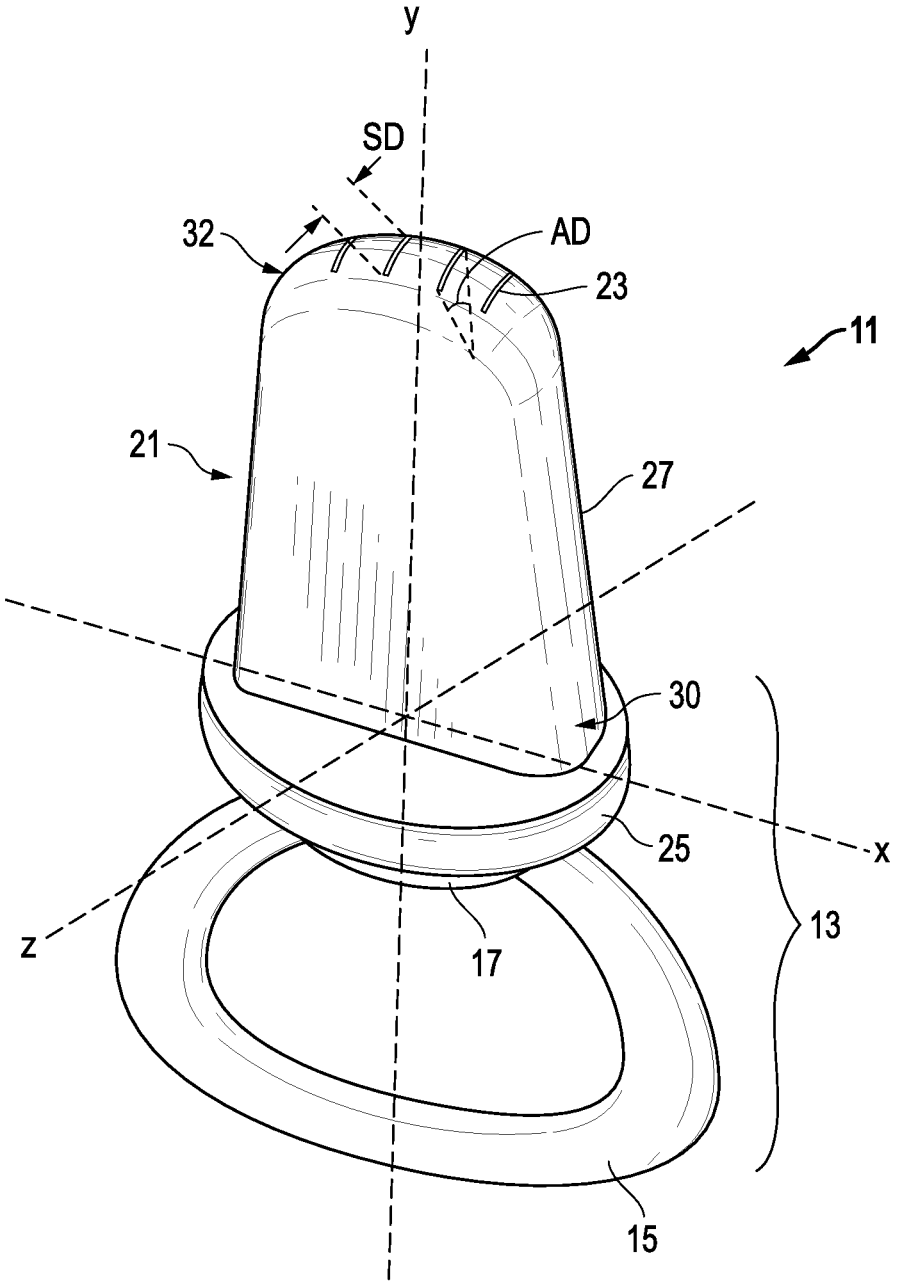
FIG. 1 is a perspective view of a teething device in accordance with embodiments disclosed herein.
Figure 2:
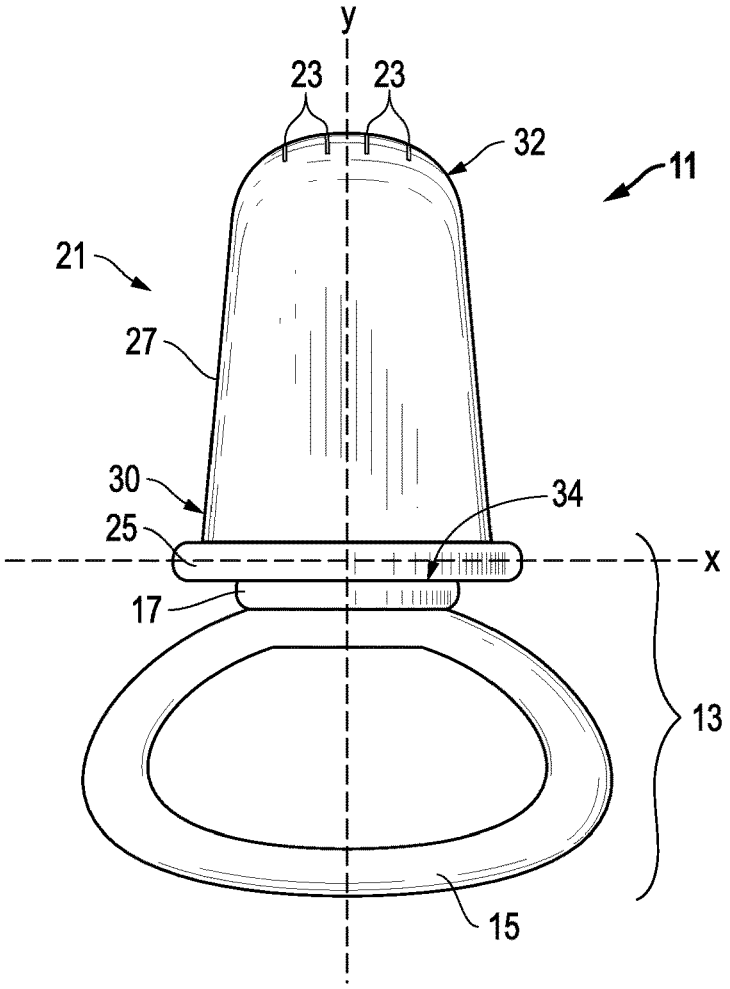
FIG. 2 is a front view of an embodiment of the teething device shown in FIG. 1.
Figure 3:
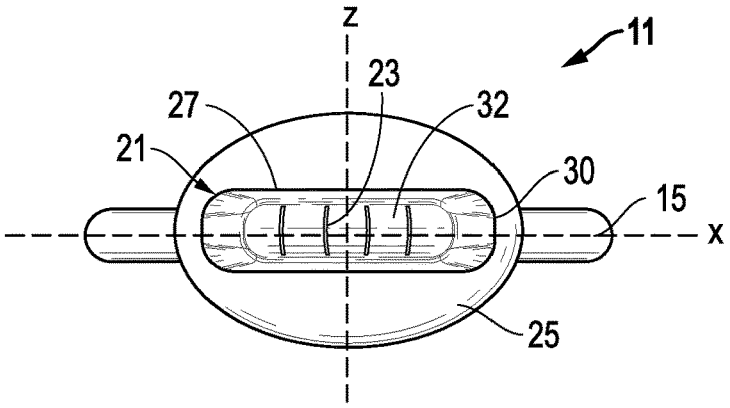
FIG. 3 is a top view of an embodiment of the teething device shown in FIG. 1.
Figure 4:
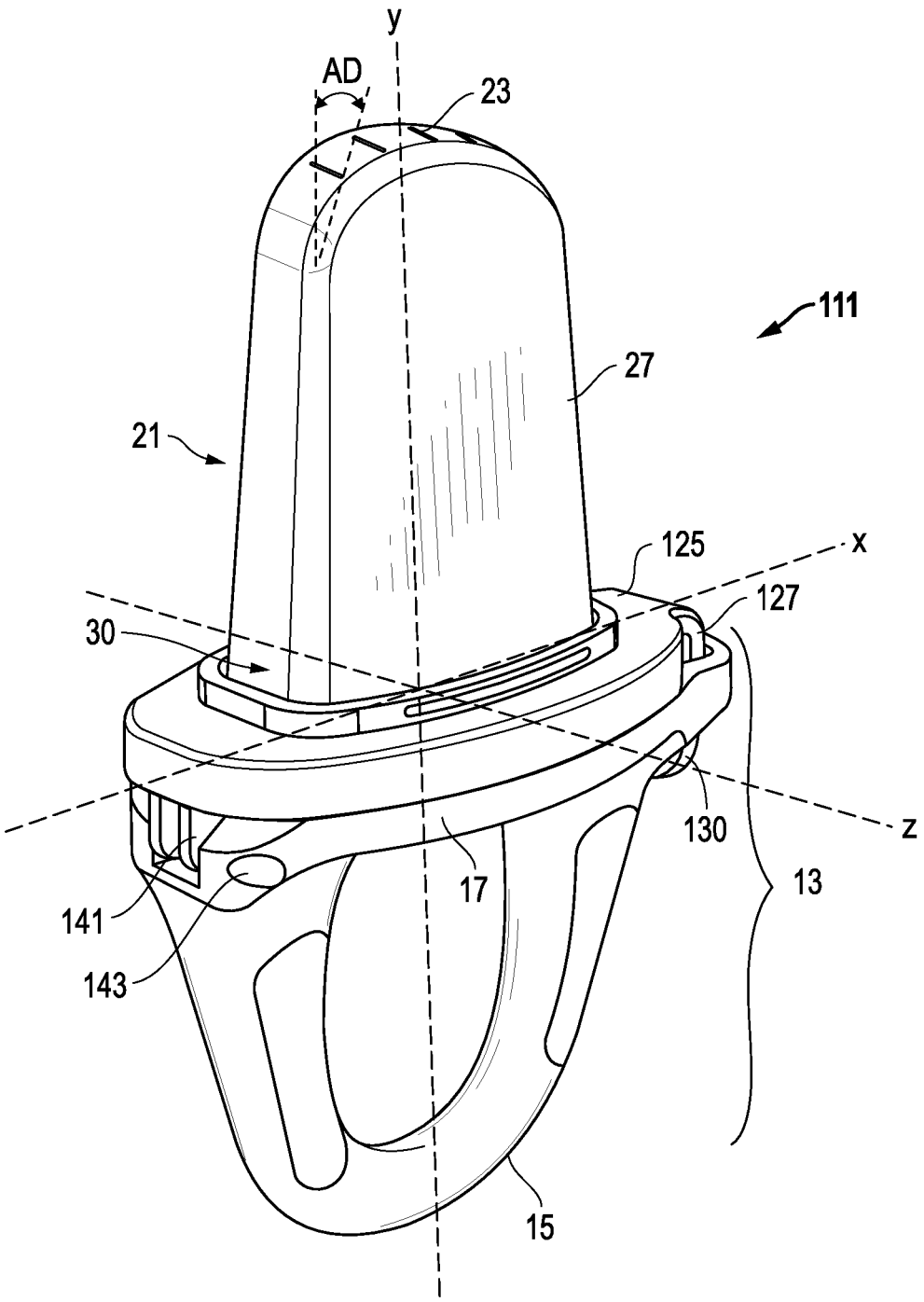
FIG. 4 is a perspective view of a teething device in accordance with embodiments disclosed herein, and is shown in a closed position.
Figure 5:
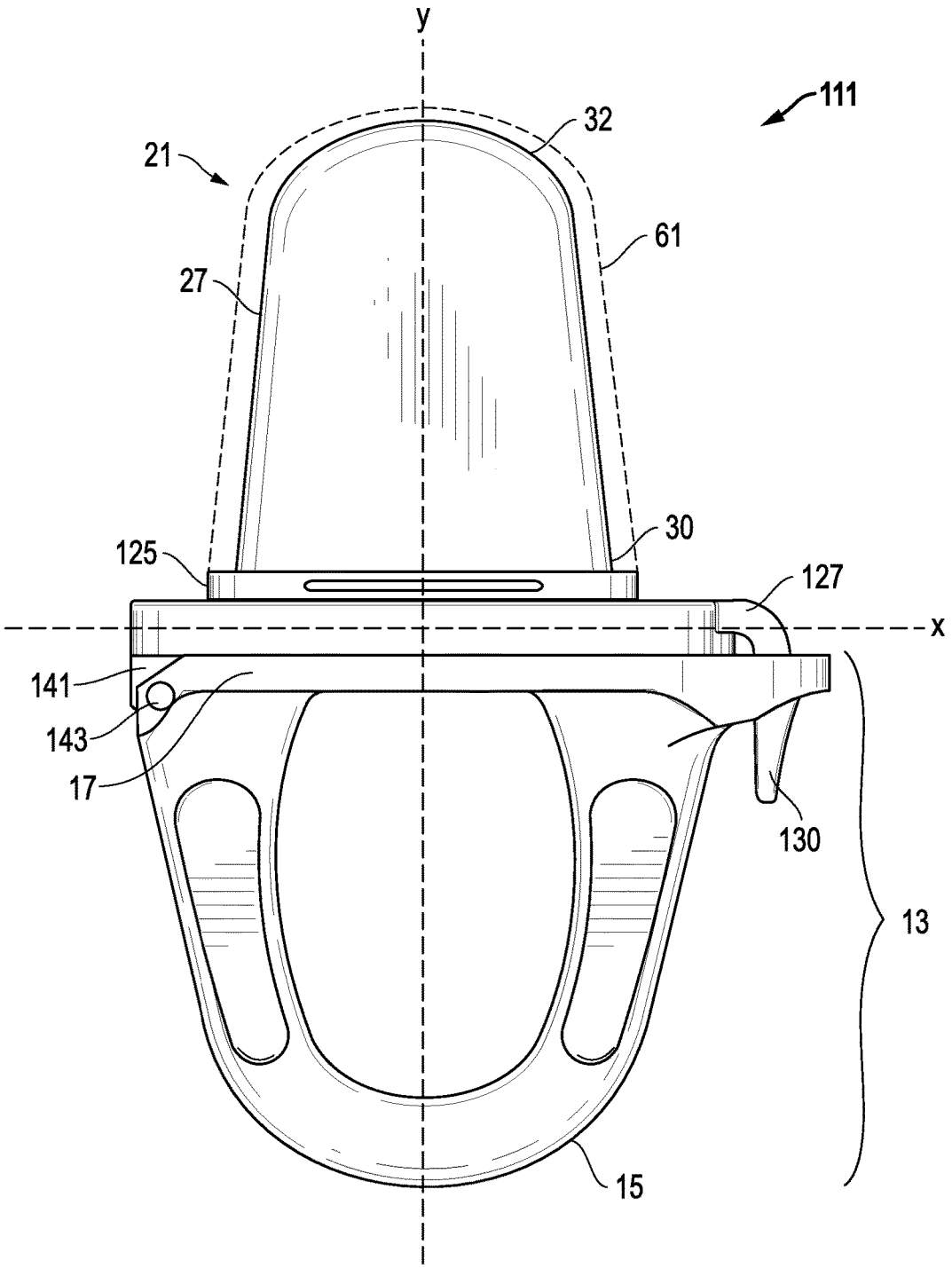
FIG. 5 is a front view of an embodiment of the teething device shown in FIG. 4.
Figure 6:
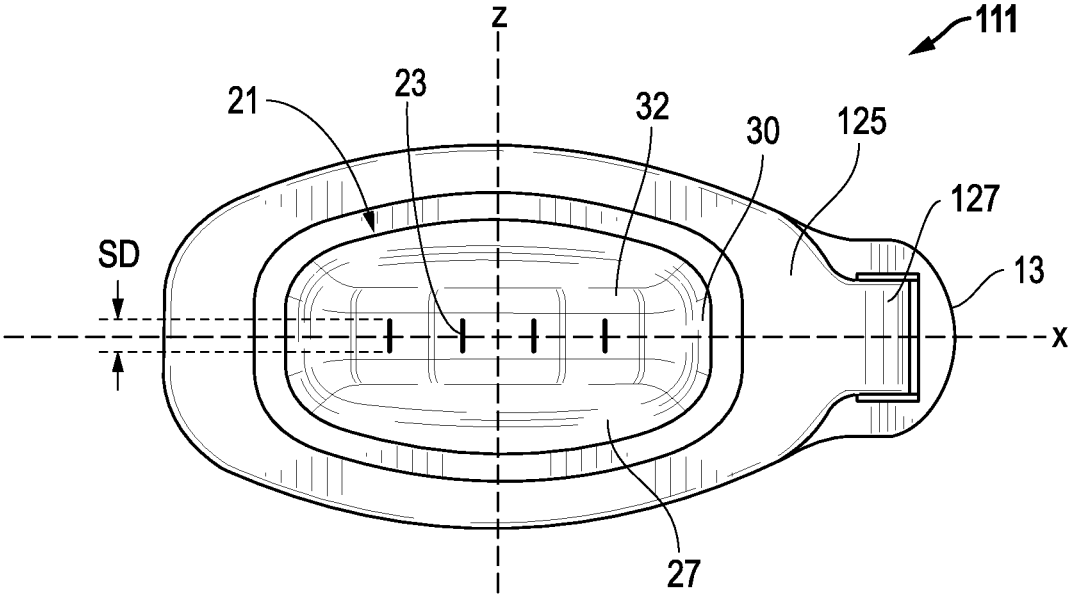
FIG. 6 is a top view of an embodiment of the teething device shown in FIG. 4.
Figure 7:
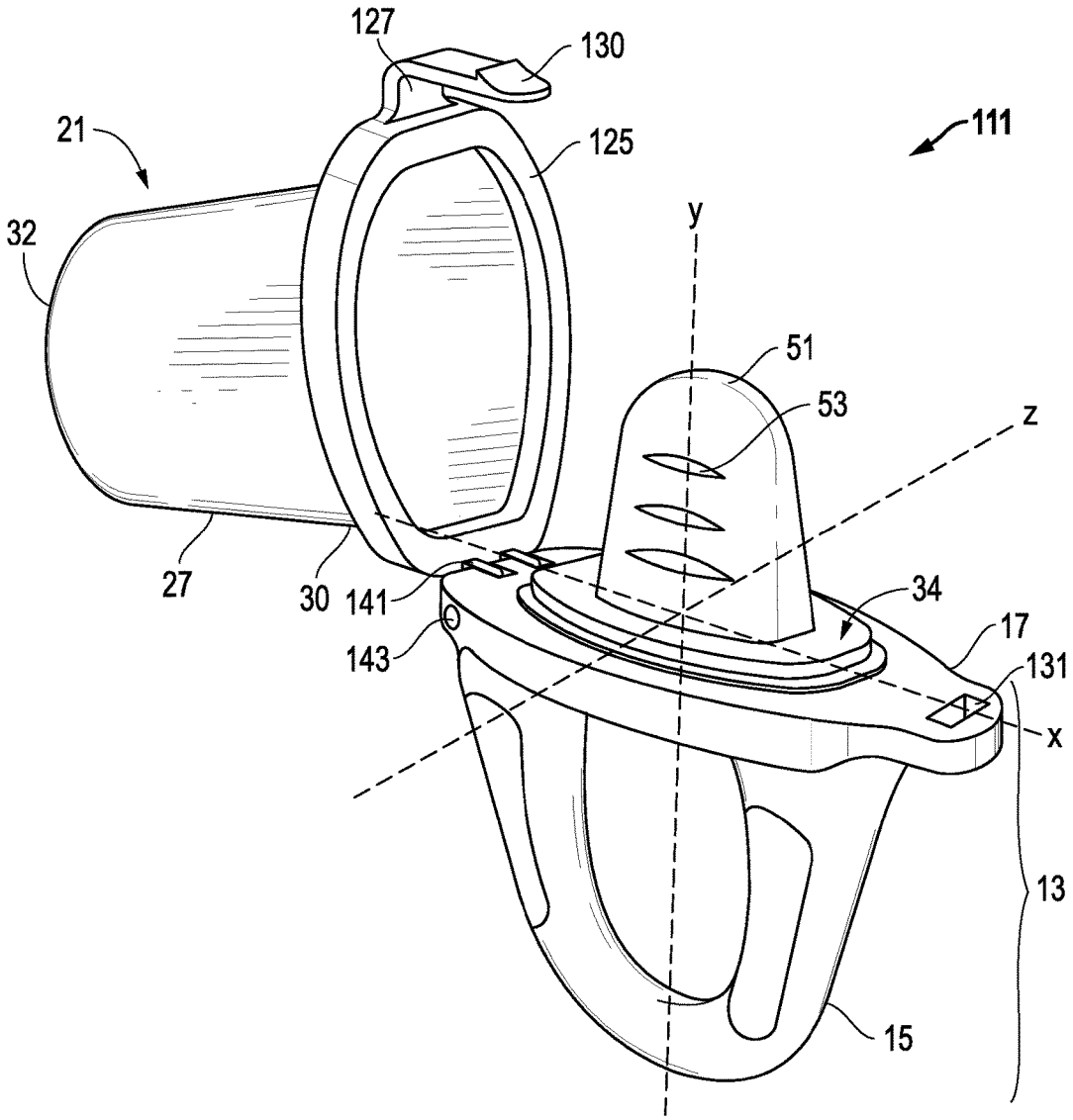
FIG. 7 is a perspective view of an embodiment of the teething device shown in FIG. 4, but shown in an open position.

For example, and as shown in FIGS. 1-3, an embodiment of a teething device 11 may include a base 13 and a reservoir 21. Embodiments of the base 13 may include a handle 15 on one end, and a top surface 34 (FIG. 2) opposite the handle 15. The handle 15 and top surface 34 may comprise a variety of shapes such as, but not limited to a circle, oval, triangle, rectangle and square. In other versions, the shape of the handle 15 may include a protrusion, such as a rod, stick or fin, allowing a user to grip the handle 15. Alternate embodiments may include the base 13 and handle 15 as two separate components. The handle 15 may be coupled to the base by any method known to those skilled in the art, such as threaded couplings, press-fit forms, co-molding, adhesives, or snap features.

In addition, the base 13 can be formed from a first material having a first hardness. In some embodiments, the first material can be a resilient material, such as a polymer. In other embodiments, the base 13 and handle 15 may be manufactured from a non-toxic material and free of Bisphenol A (BPA), phthalates, and/or polyvinyl chloride (PVC). The base 13 and handle 15 may be made of any material known to those skilled in the art to be placed in the mouth of the user. In some embodiments, the base 13 and handle 15 may be constructed of a material harder than the material of the reservoir 21.

Embodiments of the teething device 11 also may include the reservoir 21, which may be configured to contain a liquid therein. The reservoir 21 can be configured to be used as a teething device, such as for an infant or child. The reservoir 21 may have a proximal end 30 and a distal end 32. The reservoir 21 may be configured to be coupled to the base 13 and form a watertight seal therebetween.

Embodiments of the reservoir 21 can be formed from a second material having a second hardness that is softer than the first hardness of the first material of base 13. For example, the second material may include at least one of a polymer, elastomer, rubber or silicone. In other embodiments, the reservoir 21 may be manufactured from a non-toxic material and free of BPA, phthalates, and/or PVC. In some embodiments, the reservoir 21 may be constructed of non-porous and non-permeable material to prevent contents placed therein from flowing. In additional alternative embodiments, the reservoir may be provided pre-filled with and containing a liquid, such that the reservoir and/or body are disposable.

Embodiments of the base 13 and reservoir 21 can be coupled together, and uncoupled, in a number of ways. The base 13 can be configured to sealingly engage and disengage the proximal end 30 of the reservoir 21. For example, each of the top surface 34 of the base 13 and the reservoir 21 can be provided with complementary couplings, such as threaded couplings and/or watertight couplings. The top surface 34 of the base 13 can include a base coupling 17, such as a threaded coupling, which may be located opposite the handle 15. The reservoir 21 also may include an attachment portion 25, such as a threaded coupling, that may be configured to be threadingly coupled to the base coupling 17 to form the seal therebetween. In other versions, the base 13 and reservoir 21 can be snapped, plugged, press-fit or otherwise joined together without helical threads. Thus, the base 13 and reservoir 21 can have non-threaded couplings. Moreover, in other embodiments (e.g., FIG. 2), the reservoir 21 may comprise the attachment portion 25 and a body portion 27, which may be formed from the same or different materials. For example, the attachment portion 25 may be formed from the first material, and the body portion 27 may be formed from the second material.

In some embodiments, the sealing engagement and disengagement between the proximal end 30 of the reservoir 21 and the base 13 may be provided by coupling the base 13 to the proximal end 30 by a threaded engagement, a hinge (see, e.g., FIGS. 4-7), a press-fit, etc. In alternate embodiments, the base 13 and the proximal end 30 of the reservoir 21 include complimentary couplings. In still other embodiments, the top surface 34 of the base 13 may include a first coupling (e.g., base coupling 17) that sealingly engages a second coupling (e.g., attachment portion 25), which may be located on an inner surface of the proximal end 30. The first and second couplings can be complimentary and, when engaged with each other, can provide a liquid-tight seal. Other versions of the first coupling may include at least one protrusion 51 extending from the top surface 34. Some versions of the second coupling may have protrusions (not shown) extending from an inner surface of the proximal end 30, or grooves (not shown) formed within the inner surface of the proximal end 30. In other embodiments, a seal or gasket (not shown) may be provided between base 13 and reservoir 21. The proximal end 30 and top surface 34 may be coupled by any means known to those of skill in the art.

Examples of the reservoir 21 can be functionally ergonomic such that the reservoir 21 facilitates the utility of teething. In some embodiments, the distal end 32 is narrower than the proximal end 30. The distal end 32 may taper and enlarge toward the proximal end 30. In other embodiments, the reservoir 21 may have a generally flat, human tongue-like shape. Embodiments of the reservoir 21 can be generally parabolic in one or more planes of reference, such as a first plane of reference (e.g., the x-y plane), and a second plane of reference (e.g., the y-z plane). Embodiments of the reservoir 21 also can be generally elliptical in a plane of reference (see, e.g., the x-z plane) that is perpendicular the first and second planes of reference. This ergonomic design can be a relatively flat, tapered rectangular block (e.g., about 1 cm in thickness) with smoothed edges. In still other versions, the reservoir 21 can have a three-dimensional shape resembling a rectangle, square, sphere, triangle, flower, clover or any other desired shape, each of which may include a relatively flat configuration such that it is configured to fit in a user's mouth.

Embodiments of the reservoir 21 can have one or more self-sealing apertures 23 (e.g., four shown). Examples of the self-sealing apertures 23 can be formed in the reservoir and may include a closed or default position (shown in FIGS. 1-3) wherein they are configured to be self-sealing and closed, or substantially closed, to prevent the liquid from exiting therethrough. Other examples of the self-sealing apertures 23 can have an open or flexed position (not shown), wherein one or more of the self-sealing apertures 23 are squeezed or distorted from the closed position. In this latter position, one or more of the self-sealing apertures 23 are configured to be at least slightly opened to allow the liquid to flow or exit therethrough. The self-sealing apertures 23 are resiliently biased to automatically return to the closed configuration. This resilient bias allows the self-sealing apertures 23 to self-seal when the teething device 11 is not in use, i.e., when the teething device 11 is not bit or sucked on, or when a pressure is not applied to the reservoir 21, such as proximate the self-sealing apertures 23.

The self-sealing apertures 23 need not all be in the open position or in the closed position. For example, one or more of the self-sealing apertures 23 may be in the open position while, simultaneously, one or more of the other self-sealing apertures 23 are in the closed position. Usage and movement of the self-sealing apertures 23 can be determined, for example, by different sucking or biting orientations by a user.

The number and placement of the self-sealing apertures 23 may vary without departing from the scope of the present application. One or more of the self-sealing apertures 23 may span a selected displacement. For example, the self-sealing apertures 23 may span an angular displacement AD (FIG. 1). The angular displacement AD is a measure of the angle formed between the intersection of the cross-axes defined by a first end and a second end of one of the self-sealing apertures 23. In some embodiments, the angular displacement AD can be about 5 degrees to about 30 degrees, such as about 10 degrees to about 25 degrees, about 15 degrees to about 20 degrees, or in a range between any combination of these values.

In other versions, one or more of the self-sealing apertures 23 may span a selected distance SD. The selected distance SD is a measure of the distance between a first end and a second end of one of the self-sealing apertures 23. For example, the selected distance SD of the self-sealing apertures 23 can be about 1 mm to about 10 mm, such as about 3 mm to about 8 mm, about 5 mm to about 7 mm, about 0.5 mm to about 5 mm, or in a range between any combination of these values. In other versions, the SD of the self-sealing apertures can be not greater than 1 mm, such as about 0.1 mm to about 1 mm, about 0.3 mm to about 0.9 mm, about 0.5 mm to about 0.7 mm, or in a range between any combination of these values. The angular displacement AD and/or selected distance SD of the self-sealing apertures 23 may vary, such that they are not necessarily all the same, and may even have a unique angular displacement AD and selected distance SD.

In addition, one or more of the self-sealing apertures 23 may have a selected shape. For example, one or more of the self-sealing apertures 23 may be linear or non-linear. The self-sealing apertures 23 may resemble a slit (e.g., a rectangular shape) or an opening (e.g., a circular shape), such as a pin hole. In at least some of the pin hole embodiments, the self-sealing apertures 23 are still self-sealing, i.e., they are small enough to not release liquid without additional pressure on the reservoir 21. In some embodiments, each of the pin holes may have a size in a range of about 0.1 mm to about 1 mm In other embodiments, the pin holes are not self-sealing.

In some versions, the self-sealing apertures 23 may be parallel to one another, or the self-sealing apertures 23 can be non-parallel. In still other examples, two or more of the self-sealing apertures 23 can intersect or cross each other in a desired pattern (e.g., x-shaped, zig-zag, etc.). In further embodiments, at least one of the self-sealing apertures 23 can be crescent-shaped, or have other shapes known to those skilled in the art. The self-sealing apertures 23 may be arranged in a pattern on the reservoir 21, or may be arranged randomly on the reservoir 21. One of ordinary skill in the art will appreciate that the size and shape of the self-sealing apertures 23 may vary without departing from the scope of the present application.

Embodiments of the self-sealing apertures 23 may be located on only a portion of the reservoir 21. For example, the self-sealing apertures 23 may be only along the distal end 32 of the reservoir 21, as shown. Two or more of the self-sealing apertures 23 can be arrayed in a symmetrical pattern or a non-symmetrical pattern on the reservoir 21. The self-sealing apertures 23 may be located in positions on the reservoir 21 other than the distal end 32 as well. For example, the self-sealing apertures 23 may be located around an edge of the distal end 32 of the reservoir 21, along a perimeter of the reservoir 21, closer to the distal end 32 of the reservoir 21, etc.

Referring to FIGS. 4-7, an embodiment of a teething device 111 is shown. The use of the same reference symbols in different drawings indicates similar or identical items. The proximal end 30 of the reservoir 21 of teething device 111 may include a coupling 125. In some embodiments, coupling 125 include a tab 127 having a latch 130 extending therefrom. Opposite the tab 127, the reservoir 21 of teething device 111 may include a hinge mechanism 141. The coupling 125, tab 127, hinge mechanism 141 and reservoir 21 may be integrally formed.

Embodiments of the base 13 may include an aperture 131 (FIG. 7) sized to engage the latch 130 when the base 13 and the reservoir 21 are sealingly engaged. Opposite the aperture 131, the base 13 may include a complimentary hinged mechanism 143, which couples with the hinge mechanism 141 to hingedly couple the base 13 and the reservoir 21. One of ordinary skill in the art will appreciate that the base 13 may be hingedly coupled to the reservoir 21 and/or couplings to form a watertight seal in any manner known in the art.

Still other embodiments may comprise a method of using a teething device. For example, the method may comprise placing a liquid in a reservoir of the teething device having self-sealing apertures that substantially prevent the liquid from flowing therethrough; securing a base of the teething device to the reservoir such that the liquid is retained within the reservoir; placing the liquid-containing teething device in a freezer to freeze the liquid into a solid inside the teething device; removing the frozen teething device from the freezer; and then at least one of biting or sucking on the frozen teething device such that the frozen solid inside the reservoir melts and at least one of the self-sealing apertures is opened to permit at least some of the solid to thaw into the liquid and flow from said at least one of the apertures into a mouth of a user. The method also may comprise non-freezing temperatures, cool temperatures, room temperatures or heated temperatures. The method also may include substantially filling the reservoir with a liquid.

Another embodiment of a method of using the teething device may be described as follows. The method may include inverting the reservoir 21 such that a liquid may be placed in the reservoir 21. The base 13 may be sealingly engaged to the reservoir 21. The teething device may be placed in a freezer to freeze the liquid in the reservoir 21 into a solid. The frozen teething device may be removed from the freezer and a user may choose at least one of biting and sucking on the frozen teething device, such that the frozen solid inside the reservoir 21 melts and a least one of the self-sealing apertures 23 is selectively opened (by the biting or sucking action or pressure applied to the reservoir 21) to permit at least some of the liquid to flow from at least one of the self-sealing apertures 23 into a mouth of a user. Otherwise, the reservoir can retain or substantially retain the liquid therein. In some embodiments, the liquid may not be frozen to a solid, but may have the temperature of the liquid changed to a cool temperature (e.g., about 33 degrees F. to about 68 degrees F.), a room temperature (e.g., about 68 degrees F. to about 80 degrees F.), or a heated temperature (e.g., greater than about 80 degrees F.).

In some embodiments, the liquid may be consumable. In some embodiments, the teething device is capable of being thoroughly cleansed after each use, and may withstand use via cleaning solutions, dishwashing machines, microwave ovens and/or boiling water.

In another embodiment, the reservoir 21 may not include self-sealing apertures. If the reservoir 21 does not include self-sealing apertures, the base 13 may include a protrusion, such as protrusion 51 in FIG. 7, or a rod or fin, extending from the top surface 34 or other portion. The protrusion may be inserted into the reservoir 21. A method of using this embodiment may include inverting the reservoir 21 such that a fluid may be placed in the reservoir 21. The protrusion may be inserted into the reservoir 21, and the reservoir 21 and base 13 are sealingly engaged. The teething device may be placed in a freezer to freeze the liquid in the reservoir 21 into a solid. The frozen teething device may be removed from the freezer and the reservoir 21 unsealed from the base, thereby producing a popsicle frozen to the base 13 and protrusion. Mechanical features 53, such as holes, etc. on the protrusion 51 may used to allow the frozen popsicle to better grip and be retained by the base 13. In some embodiments, the reservoir 21 may be partially or completely removable from the base 13 to expose a popsicle.

In another embodiment, the teething device may include a removable cap 61 (FIG. 5), which may be placed over the reservoir 21 to cover the self-sealing apertures 23. The removable cap 61 may be made non-toxic material and free of BPA, phthalates, and/or PVC. Examples of suitable materials may include polymer, rubber, silicone, etc., suitable for use in a user's mouth. In some embodiments, the removable cap may be formed from a material that is harder than the material used to form reservoir 21.

Figure 8:
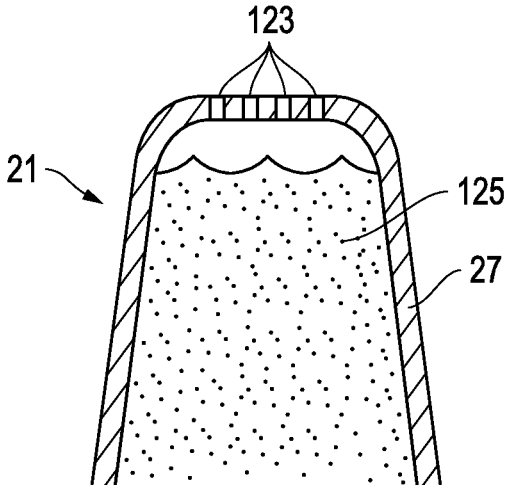
FIG. 8 is a sectional front view of an alternate embodiment of a reservoir.

FIG. 8 depicts an alternate embodiment of a reservoir 21 having a body 27 with one or more apertures 123. Apertures 123 are not self-sealing, or can be substantially self-sealing, and are large enough to not impede liquid 125 from flowing therethrough. Although larger in size than self-sealing apertures 23, apertures 123 may embody any suitable forms, such as the shapes, arrangements, etc., described herein for self-sealing apertures 23.

Figure 9:
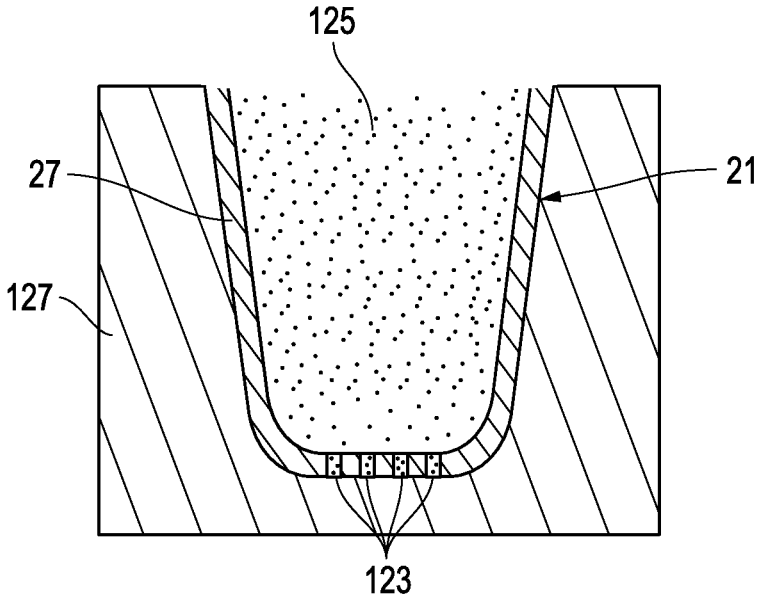
FIG. 9 is a sectional front view of the alternate embodiment of the reservoir of FIG. 8 in a tray.

As shown in FIG. 9, liquid 125 may be frozen inside reservoir 21 by placing it in a tray 127 having a shape that is complementary to reservoir 21. Their combination can be inverted as shown, and then placed in a freezer. Tray 127 can prevent the liquid 125 from flowing through apertures 123 while the liquid 125 is being frozen.

Other embodiments may include one or more of the following items:

Item 1. A teething device, comprising:

a base having a handle on an end and a coupling on an opposite end, the base being formed from a first material having a first hardness;

a reservoir configured to contain a liquid therein and configured to be coupled to the base coupling and form a watertight (or, in the alternative, substantially watertight) seal therebetween, the reservoir having a plurality of self-sealing apertures formed therein, wherein each of the self-sealing apertures has a default position wherein each self-sealing aperture is configured to be substantially closed to prevent the liquid from exiting therethrough, and a flexed position wherein each self-sealing aperture is configured to be opened to allow the liquid to exit therethrough; and the reservoir is formed from a second material having a second hardness that is softer than the first hardness, such that the reservoir is configured to be used as a teething device.

Item 2. The teething device of item 1, wherein the reservoir is tongue-shaped.

Item 3. The teething device of item 1, wherein the reservoir is generally parabolic in a first plane of reference, and generally elliptical in a second plane of reference that is perpendicular the first plane of reference.

Item 4. The teething device of item 1, wherein the base has a threaded coupling opposite the handle, the reservoir has a threaded coupling configured to be threadingly coupled to the base threaded coupling to form the seal therebetween.

Item 5. The teething device of item 1, wherein each of the self-sealing apertures spans an angular displacement of about 5 degrees to about 30 degrees.

Item 6. The teething device of item 1, wherein each of the self-sealing apertures spans a distance of about 1 mm to about 10 mm Item 7. The teething device of item 1, wherein the self-sealing apertures comprise slits.

Item 8. The teething device of item 1, wherein the self-sealing apertures are not parallel slits.

Item 9. The teething device of item 1, wherein the self-sealing apertures intersect or cross each other.

Item 10. The teething device of item 1, wherein the self-sealing apertures are non-linear.

Item 11. The teething device of item 1, wherein the self-sealing apertures are crescent-shaped.

Item 12. The teething device of item 1, wherein the self-sealing apertures are located only along a distal end of the reservoir.

Item 13. The teething device of item 1, wherein the self-sealing apertures are arrayed in a symmetrical pattern along the distal end of the reservoir.

Item 14. The teething device of item 1, wherein the base and reservoir have non-threaded, watertight couplings.

Item 15. The teething device of item 1, wherein the first material comprises a polymer.

Item 16. The teething device of item 1, wherein the second material comprises at least one of an elastomer, rubber or silicone.

Item 17. The teething device of item 1, wherein the reservoir comprises an attachment portion formed from the first material, and a body portion formed from the second material.

Item 18. A method of using a teething device, comprising:

(a) placing a liquid in a reservoir of the teething device having self-sealing apertures that substantially prevent the liquid from flowing therethrough;

(b) securing a base of the teething device to the reservoir such that the liquid is retained within the reservoir;

(c) placing the liquid-containing teething device in a freezer to freeze the liquid into a solid inside the teething device;

(d) removing the frozen teething device from the freezer; and then (e) at least one of biting or sucking on the frozen teething device such that the frozen solid inside the reservoir melts and at least one of the self-sealing apertures is opened to permit at least some of the solid to thaw into the liquid and flow from said at least one of the apertures into a mouth of a user.

Item 19. The method of item 18, wherein step (a) comprises substantially filling the reservoir with the liquid.

Item 20. A teething device, comprising:

a reservoir fillable from a proximal end and having a plurality of self-sealing apertures on a distal end;

a base having a top surface configured to sealingly engage and disengage the proximal end of the reservoir; and a handle coupled to the base opposite the top surface.

Item 21. The teething device of item 20, wherein the handle is sized to fit the hand of a user.

Item 22. The teething device of item 21, wherein the handle is adjustable to fit the hand of the user.

Item 23. The teething device of item 20, wherein the base and the handle are integrally formed.

Item 24. The teething device of item 20, wherein the reservoir and the base are hingedly coupled.

Item 25. The teething device of item 20, wherein the base and the reservoir are threadingly coupled.

Item 26. The teething device of item 20, wherein the base and the reservoir are snap-fitted together.

Item 27. The teething device of item 20, further comprising a removable cap sized to be placed over the distal end of the reservoir.

Item 28. The teething device of item 20, wherein the distal end of the reservoir is sized to fit the mouth of a user.

Item 29. The teething device of item 20, wherein the base further comprises a protrusion for insertion into the reservoir.

Item 30. The teething device of item 20, wherein the teething device is formed from a non-toxic material.

Item 31. The teething device of item 20, wherein the plurality of self-sealing aperture span a elected distance from about 1 mm to about 10 mm Item 32. The teething device of item 20, wherein the plurality of self-sealing apertures spans an angular displacement of about 5 degrees to about 30 degrees.

Item 33. The teething device of item 20, wherein the reservoir further comprises a latch on the proximal end configured to engage with an aperture on the base.

Item 34. The teething device of item 20, wherein the reservoir is generally parabolic in a first plane of reference, and generally elliptical in a second plane of reference that is perpendicular to the first plane of reference.

Item 35. A teething device, comprising:

a base having a handle on an end and a coupling on an opposite end, the base and coupling being formed from a first material having a first hardness;

a reservoir configured to contain a liquid therein, the reservoir is coupled and sealed to the base coupling and configured to provide a watertight seal, the reservoir has at least one self-sealing aperture formed therein, said at least one self-sealing aperture has a default position wherein said at least one self-sealing aperture is configured to be substantially closed to essentially prevent the liquid from flowing therethrough, and a flexed position wherein said at least one self-sealing aperture is configured to be opened to allow the liquid to flow therethrough; and the reservoir is formed from a second material having a second hardness that is softer than the first hardness, such that the reservoir is configured to be used as a teething device.

Item 36. The teething device of item 35, wherein the reservoir is generally parabolic in a first plane of reference, and generally elliptical in a second plane of reference that is perpendicular to the first plane of reference, such that the reservoir is substantially tongue-shaped.

Item 37. The teething device of item 35, wherein the reservoir is pre-filled with and contains the liquid, and the teething device is disposable.

Item 38. The teething device of item 35, wherein the base coupling is threaded, the reservoir has a threaded coupling configured to be threadingly coupled to the threaded base coupling to form the watertight seal therewith.

Item 39. The teething device of item 35, wherein said at least one self-sealing aperture spans an angular displacement of at least about 5 degrees to not greater than about 30 degrees.

Item 40. The teething device of item 35, wherein said at least one self-sealing aperture spans a distance of at least about 0.5 mm to not greater than about 5 mm Item 41. The teething device of item 35, wherein said at least one self-sealing aperture comprises a plurality of slits.

Item 42. The teething device of item 41, wherein the self-sealing apertures are located only along a distal end of the reservoir.

Item 43. The teething device of item 41, wherein the self-sealing apertures are arrayed in a symmetrical pattern along a distal end of the reservoir.

Item 44. The teething device of item 41, wherein at least some of the self-sealing apertures either intersect each other or cross each other, and the self-sealing apertures are non-linear.

Item 45. The teething device of item 35, wherein the reservoir and base are manufactured from at least one of a non-toxic thermoplastic elastomer and polypropylene, the reservoir is pre-filled with and contains a consumable liquid, and the teething device is capable of being frozen and is disposable.

Item 46. The teething device of item 35, wherein said at least one self-sealing aperture comprises a plurality of pin holes.

Item 47. The teething device of item 35, wherein the base and reservoir have non-threaded, watertight couplings.

Item 48. The teething device of item 35, wherein the first material comprises a polymer, and the second material comprises at least one of an elastomer, rubber or silicone.

Item 49. The teething device of item 35, wherein the reservoir comprises a coupling formed from the first material, and a body formed from the second material.

Item 50. The teething device of item 35, wherein the reservoir and the base are hingedly coupled to move between an open position wherein the reservoir is pivotable away from a portion of the base, and a closed position wherein the reservoir closes against and seals with the base.

Item 51. The teething device of item 50, wherein the reservoir further comprises a latch on a proximal end thereof that engages an aperture on the base in the closed position, and the reservoir and the base lock together in the closed position.

Item 52. The teething device of item 35, further comprising a removable cap, mounted to the base, and sized to be placed over and cover the reservoir.

Item 53. The teething device of item 35, wherein the base further comprises a protrusion that extends into the reservoir, and the teething device is configured to form a popsicle on the protrusion when a liquid is frozen inside the reservoir.

Item 54. The teething device of item 53, wherein the reservoir is removable from the popsicle and the base.

Item 55. A teething device, comprising:

a base having a handle on an end and a coupling on an opposite end, the base and coupling being formed from a first material having a first hardness;

a reservoir configured to contain a liquid therein, the reservoir is coupled and sealed to the base coupling and configured to provide a watertight seal, the reservoir has at least one pin hole formed therein, wherein said at least one pin hole has a default position wherein said at least one pin hole is configured to be open to allow the liquid to flow therethrough;

the reservoir is formed from a second material having a second hardness that is softer than the first hardness, such that the reservoir is configured to be used as a teething device.

Item 56. The teething device of item 55, further comprising a removable cap, mounted to the base, and sized to be placed over and cover the reservoir; and a tray configured to collectively support the teething device and removable cap when the teething device and removable cap are inverted.

57. The teething device of item 55, wherein the base further comprises a protrusion that extends into the reservoir, and the teething device is configured to form a popsicle on the protrusion when a liquid is frozen inside the reservoir.

58. The teething device of item 57, wherein the reservoir is removable from the popsicle and the base.

Item 59. The teething device of item 55, wherein the reservoir is pre-filled with and contains the liquid, which is consumable, said at least one pin hole is temporarily sealed with a removable seal, and the teething device is disposable.

Item 60. A teething device, comprising:

a base having a handle on an end and a coupling on an opposite end, the base and coupling being formed from a first material having a first hardness;

a reservoir configured to contain a liquid therein, the reservoir is coupled and sealed to the base coupling and configured to provide a watertight seal, the reservoir has at least one self-sealing aperture formed therein, said at least one self-sealing aperture has a default position wherein said at least one self-sealing aperture is configured to be substantially closed to essentially prevent the liquid from flowing therethrough, and a flexed position wherein said at least one self-sealing aperture is configured to be opened to allow the liquid to flow therethrough; and the reservoir is formed from a second material having a second hardness that is softer than the first hardness, such that the reservoir is configured to be used as a teething device and capable of being frozen.

Item 61. The teething device of item 60, wherein the reservoir is generally parabolic in a first plane of reference, and generally elliptical in a second plane of reference that is perpendicular to the first plane of reference, such that the reservoir is generally tongue-shaped.

Item 62. The teething device of item 60, wherein the reservoir is pre-filled with and contains the liquid, which is consumable, and the teething device is disposable and capable of being frozen with the liquid in it.

Item 63. The teething device of item 60, wherein the base coupling is threaded, the reservoir has a threaded coupling configured to be threadingly coupled to the threaded base coupling to form the watertight seal therewith.

Item 64. The teething device of item 60, wherein the base and reservoir have non-threaded, watertight couplings.

Item 65. The teething device of item 60, wherein said at least one self-sealing aperture spans an angular displacement of at least about 1 degree to not greater than about 30 degrees.

Item 66. The teething device of item 60, wherein said at least one self-sealing aperture spans a distance of at least about 0.5 mm to not greater than about 5 mm Item 67. The teething device of item 60, wherein said at least one self-sealing aperture comprises at least one of a plurality of self-sealing apertures, a plurality of slits and at least one pin hole.

Item 68. The teething device of item 67, wherein the self-sealing apertures are located only along a distal end of the reservoir.

Item 69. The teething device of item 67, wherein the self-sealing apertures are arrayed in a symmetrical pattern along a distal end of the reservoir.

Item 70. The teething device of item 67, wherein at least some of the self-sealing apertures either intersect each other or cross each other, and the self-sealing apertures are at least one of parallel, linear, diagonal, and non-linear.

Item 71. The teething device of item 60, wherein the reservoir and base are manufactured from at least one of a non-toxic thermoplastic elastomer and polypropylene, the reservoir is pre-filled with and contains a consumable liquid, and the teething device is capable of being frozen and is disposable.

Item 72. The teething device of item 60, wherein the first material comprises a polymer, and the second material comprises at least one of an elastomer, rubber or silicone.

Item 73. The teething device of item 60, wherein the reservoir comprises a coupling formed from the first material, and a body formed from the second material.

Item 74. The teething device of item 60, wherein the reservoir and the base are hingedly coupled to move between an open position wherein the reservoir is pivotable away from a portion of the base, and a closed position wherein the reservoir closes against and seals with the base.

Item 75. The teething device of item 74, wherein the reservoir further comprises a latch on a proximal end thereof that engages an aperture on the base in the closed position, and the reservoir and the base lock together in the closed position.

Item 76. The teething device of item 60, further comprising a removable cap, mounted to the base, and sized to be placed over and cover the reservoir.

Item 77. The teething device of item 76, further comprising a tray configured to collectively support the teething device and removable cap when the teething device and removable cap are inverted.

Item 78. The teething device of item 76, wherein the removable cap fits tightly on the reservoir to further inhibit the flow of liquid through the at least one self-sealing aperture.

Item 79. The teething device of item 60, wherein the base further comprises a protrusion that extends into the reservoir.

Item 80. The teething device of item 79, wherein the teething device is configured to form a popsicle on the protrusion when a liquid is frozen inside the reservoir.

Item 81. The teething device of item 80, wherein the reservoir is removable from the frozen liquid to form the popsicle.

Item 82. A teething device, comprising:

a base having a handle on an end and a coupling on an opposite end, the base and coupling being formed from a first material having a first hardness;

a reservoir configured to contain a liquid therein, the reservoir is coupled and sealed to the base coupling and configured to provide a watertight seal, the reservoir has at least one pin hole formed therein, wherein said at least one pin hole has a default position wherein said at least one pin hole is configured to be open to allow the liquid to flow therethrough, such that said at least one pin hole is not self-sealing;

the reservoir is formed from a second material having a second hardness that is softer than the first hardness, such that the reservoir is configured to be used as a teething device.

Item 83. The teething device of item 82, further comprising a removable cap, mounted to the base, and sized to be placed over and cover the reservoir.

Item 84. The teething device of item 83, further comprising a tray configured to collectively support the teething device and removable cap when the teething device and removable cap are inverted.

Item 85. The teething device of item 82, wherein the base further comprises a protrusion that extends into the reservoir.

Item 86. The teething device of item 85, wherein the teething device is configured to form a popsicle on the protrusion when a liquid is frozen inside the reservoir.

Item 87. The teething device of item 86, wherein the reservoir is removable from the frozen liquid to form the popsicle.

Item 88. The teething device of item 87, wherein the reservoir is pre-filled with and contains the liquid, which is consumable, said at least one pin hole is temporarily sealed with a removable seal, and the teething device is disposable and capable of being frozen with the liquid in it.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also to includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

We claim:

1. A teething device, comprising:

a base having a handle on an end and a coupling on an opposite end, a y-axis extending through both the handle and the coupling, an x-axis and a z-axis extending perpendicular to the y-axis and to each other, and the base and coupling being formed from a first material having a first hardness;

a reservoir configured to contain a liquid therein, the reservoir having a coupling sealed to the base coupling and configured to provide a watertight seal, the reservoir has apertures that are the only apertures formed therein, the apertures consist of slits that are repeatably self-sealing, all of the slits are located only along a terminal distal end of the reservoir, each slit has a default position wherein each slit is configured to be resiliently biased to automatically return to be substantially closed to essentially prevent the liquid from flowing therethrough, and a flexed position wherein each slit is configured to be opened by squeezing to allow the liquid to flow therethrough;

the base further comprises a protrusion that extends into the reservoir, and the protrusion is spaced apart and free of contact with the reservoir;

the reservoir is formed from a second material having a second hardness that is softer than the first hardness, such that the reservoir is configured to be used as a teething device and capable of being frozen; and the reservoir comprises a shape that is parabolic in a first plane of reference defined by the x-axis and the y-axis, and the reservoir has a second shape that is elongated and generally elliptical in a second plane of reference defined by the x-axis and the z-axis, such that an entirety of the reservoir is generally human tongue-shaped.

2. The teething device of claim 1, wherein the reservoir is pre-filled with and contains the liquid, which is consumable, and the teething device is disposable.

3. The teething device of claim 1, wherein the base coupling is threaded, the reservoir coupling is threaded and configured to be threadingly coupled to the threaded base coupling to form the watertight seal therewith.

4. The teething device of claim 1, wherein the base coupling and reservoir coupling are non-threaded.

5. The teething device of claim 1, wherein each slit spans an angular displacement of at least about 1 degree to not greater than about 30 degrees.

6. The teething device of claim 1, wherein each slit spans a distance of at least about 0.5 mm to not greater than about 5 mm.

7. The teething device of claim 1, wherein all of the slits are at least one of parallel, linear or diagonal to at least one of the axes.

8. The teething device of claim 1, wherein the first material comprises a polymer, and the second material comprises at least one of the group consisting of: an elastomer, rubber and silicone.

9. The teething device of claim 1, wherein the reservoir and the base are hingedly coupled to move between an open position wherein the reservoir is pivotable away from a portion of the base, and a closed position wherein the reservoir coupling closes against and seals with the base coupling.

10. The teething device of claim 9, wherein the reservoir further comprises a latch on a proximal end thereof that engages an aperture on the base in the closed position, and the reservoir and the base lock together in the closed position.

11. The teething device of claim 1, further comprising a removable cap, mounted to the base, and sized to be placed over and cover the reservoir.

12. The teething device of claim 11, wherein the removable cap fits tightly on the reservoir to further inhibit the flow of liquid through the slits.

13. The teething device of claim 1, wherein the teething device is configured to form a popsicle on the protrusion when a liquid is frozen inside the reservoir.

14. The teething device of claim 13, wherein the reservoir is removable from the frozen liquid to expose the popsicle on the protrusion.

15. A teething device, comprising:

a base having a handle on an end and a coupling on an opposite end, a y-axis extending through both the handle and the coupling, an x-axis and a z-axis extending perpendicular to the y-axis and to each other, and the base and coupling being formed from a first material having a first hardness;

a reservoir configured to contain a liquid therein, the reservoir having a coupling sealed to the base coupling and configured to provide a watertight seal, the reservoir has apertures that are the only apertures formed therein, the apertures consist of slits that are repeatably self-sealing, each slit has a default position configured to be resiliently biased to automatically return to be substantially closed to essentially prevent the liquid from flowing therethrough, and a flexed position wherein each slit is configured to be opened by squeezing to allow the liquid to flow therethrough, all of the slits are located only along a terminal distal end of the reservoir, and all of the slits are at least one of parallel, linear and diagonal relative to at least one of the axes;

the reservoir comprises a shape that is parabolic in a first plane of reference defined by the x-axis and the y-axis, and the reservoir has a second shape that is elongated and generally elliptical in a second plane of reference defined by the x-axis and the z-axis, such that an entirety of the reservoir is generally human tongue-shaped;

the reservoir is formed from a second material having a second hardness that is softer than the first hardness, such that the reservoir is configured to be used as a teething device and capable of being frozen; and the base further comprises a protrusion that extends into the reservoir, the protrusion is spaced apart and free of contact with the reservoir, the teething device is configured to form a popsicle on the protrusion when a liquid is frozen inside the reservoir, and the reservoir is removable from the frozen liquid to expose the popsicle on the protrusion.

16. The teething device of claim 15, wherein the reservoir further comprises a latch on a proximal end thereof that engages an aperture on the base in the closed position, and the reservoir and the base lock together in the closed position.

17. The teething device of claim 15, further comprising a removable cap that fits tightly on the reservoir to further inhibit the flow of liquid through the self-sealing apertures.

18. A teething device, comprising:

a base having a handle on an end and a coupling on an opposite end, a y-axis extending through both the handle and the coupling, an x-axis and a z-axis extending perpendicular to the y-axis and to each other, and the base and coupling being formed from a first material having a first hardness;

a reservoir configured to contain a liquid therein, the reservoir having a coupling sealed to the base coupling and configured to provide a watertight seal, the reservoir has apertures that are the only apertures formed therein, the apertures consist of slits that are repeatably self-sealing, all of the slits are located only along a terminal distal end of the reservoir, each slit has a default position wherein each slit is configured to be resiliently biased to automatically return to be substantially closed to essentially prevent the liquid from flowing therethrough, and a flexed position wherein each slit is configured to be opened by squeezing to allow the liquid to flow therethrough;

each slit spans an angular displacement of at least about 1 degree to not greater than about 30 degrees, each slit spans a distance of at least about 0.5 mm to not greater than about 5 mm;

the reservoir is formed from a second material having a second hardness that is softer than the first hardness, the first material comprises a polymer and the second material comprises at least one of the group consisting of: an elastomer, rubber and silicone, such that the reservoir is configured to be used as a teething device and capable of being frozen;

the reservoir comprises a shape that is parabolic in a first plane of reference defined by the x-axis and the y-axis, and the reservoir has a second shape that is elongated and generally elliptical in a second plane of reference defined by the x-axis and the z-axis, such that an entirety of the reservoir is generally human tongue-shaped;

the reservoir and the base are hingedly coupled to move between an open position wherein the reservoir is pivotable away from a portion of the base, and a closed position wherein the reservoir closes against and seals with the base, the reservoir comprises a latch on a proximal end thereof that engages an aperture on the base in the closed position, and the reservoir and the base lock together in the closed position;

the base further comprises a protrusion that extends into the reservoir, the protrusion is spaced apart and free of contact with the reservoir, the teething device is configured to form a popsicle on the protrusion when a liquid is frozen inside the reservoir, and the reservoir is removable from the frozen liquid to expose the popsicle on the protrusion; and the teething device further comprises:

a removable cap mounted to the base and sized to be placed over and cover the reservoir, the removable cap fits tightly on the reservoir to further inhibit the flow of liquid through the slits.

* * * * *